US008061457B2

(12) United States Patent
Hall et al.

(10) Patent No.: US 8,061,457 B2
(45) Date of Patent: Nov. 22, 2011

(54) CHAMFERED POINTED ENHANCED DIAMOND INSERT

(75) Inventors: David R. Hall, Provo, UT (US); Ronald B. Crockett, Payson, UT (US)

(73) Assignee: Schlumberger Technology Corporation, Houston, TX (US)

( * ) Notice: Subject to any disclaimer, the term of this patent is extended or adjusted under 35 U.S.C. 154(b) by 185 days.

(21) Appl. No.: 12/372,302

(22) Filed: Feb. 17, 2009

(65) Prior Publication Data

US 2010/0206641 A1 Aug. 19, 2010

(51) Int. Cl.
*E21B 10/52* (2006.01)

(52) U.S. Cl. ..... 175/430; 175/432

(58) Field of Classification Search ..... 175/426, 175/430, 432

See application file for complete search history.

(56) References Cited

U.S. PATENT DOCUMENTS

| | | | |
|---|---|---|---|
| 2,004,315 | A | 6/1935 | Fean |
| 2,124,438 | A | 7/1938 | Struk |
| 3,254,392 | A | 6/1966 | Novkov |
| 3,626,775 | A | 12/1971 | Gentry |
| 3,746,396 | A | 7/1973 | Radd |
| 3,807,804 | A | 4/1974 | Kniff |
| 3,821,993 | A | 7/1974 | Kniff et al. |
| 3,830,321 | A | 8/1974 | McKenry |
| 3,932,952 | A | 1/1976 | Helton |
| 3,945,681 | A | 3/1976 | White |
| 4,005,914 | A | 2/1977 | Newman |
| 4,006,936 | A | 2/1977 | Crabiel |
| 4,098,362 | A | 7/1978 | Bonnice |
| 4,109,737 | A | 8/1978 | Bovenkerk |
| 4,156,329 | A | 5/1979 | Daniels |
| 4,199,035 | A | 4/1980 | Thompson |
| 4,201,421 | A | 5/1980 | Den Besten |
| 4,277,106 | A | 7/1981 | Sahley |
| 4,333,902 | A | 6/1982 | Hara |
| 4,333,986 | A | 6/1982 | Tsuji et al. |
| 4,412,980 | A | 11/1983 | Tsuji et al. |
| 4,425,315 | A | 1/1984 | Tsuji et al. |
| 4,439,250 | A | 3/1984 | Acharya |
| 4,465,221 | A | 8/1984 | Schmidt |

(Continued)

FOREIGN PATENT DOCUMENTS

| | | |
|---|---|---|
| DE | 3500261 | 7/1986 |

(Continued)

OTHER PUBLICATIONS

NPL—International search report for PCT/US2007/075670, mailed Nov. 17, 2008.

*Primary Examiner* — William P Neuder

(74) *Attorney, Agent, or Firm* — Brinks Hofer Gilson & Lione

(57) ABSTRACT

An impact tool that includes an impact body made from a superhard material bonded to a substrate at a non-planer interface, the impact body having a pointed geometry that includes a substantially frustoconical portion between an apex and a base end, the substantially frustoconical portion including a tapered side wall with at least two different, contiguous slopes that together form an interior included angle which is greater than 135 degrees, and with the thickness of the impact body, as measured from the apex to the non-planar interface, being greater than the thickness of the substrate.

21 Claims, 9 Drawing Sheets

U.S. PATENT DOCUMENTS 4,484,644 A 11/1984 Cook
4,489,986 A 12/1984 Dziak
4,636,253 A 1/1987 Nakai et al.
4,647,111 A 3/1987 Bronder
4,678,237 A 7/1987 Collin
4,682,987 A 7/1987 Brady
4,688,856 A 8/1987 Elfgen
4,725,098 A 2/1988 Beach
4,729,603 A 3/1988 Elfgen
4,765,686 A 8/1988 Adams
4,765,687 A 8/1988 Parrott
4,776,862 A 10/1988 Wiand
4,880,154 A 11/1989 Tank
4,932,723 A 6/1990 Mills
4,940,288 A 7/1990 Stiffler
4,944,559 A 7/1990 Sionnet
4,951,762 A 8/1990 Lundell
4,956,238 A 9/1990 Griffin
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,261,499 A 11/1993 Grubb
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,544,713 A 8/1996 Dennis
5,653,300 A 8/1997 Lund
5,662,720 A 9/1997 O'Tighearnaigh
5,709,279 A * 1/1998 Dennis ..... 175/430
5,738,698 A 4/1998 Kapoor
5,823,632 A 10/1998 Burkett
5,837,071 A 11/1998 Anderson
5,845,547 A 12/1998 Sollami
5,848,657 A 12/1998 Flood
5,875,862 A 3/1999 Jurewicz
5,890,552 A 4/1999 Scott et al.
5,934,542 A 8/1999 Nakamura
5,935,718 A 8/1999 Demo
5,944,129 A 8/1999 Jensen
5,967,250 A 10/1999 Lund
5,992,405 A 11/1999 Sollami
6,000,483 A 12/1999 Jurewicz et al.
6,003,623 A 12/1999 Miess
6,006,846 A 12/1999 Tibbitts
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,068,913 A 5/2000 Cho et al.
6,098,730 A 8/2000 Scott et al.
6,113,195 A 9/2000 Mercier
6,170,917 B1 1/2001 Heinrich
6,193,770 B1 2/2001 Sung
6,196,340 B1 3/2001 Jensen et al.
6,196,636 B1 3/2001 Mills
6,196,910 B1 3/2001 Johnson
6,199,956 B1 3/2001 Kammerer
6,216,805 B1 4/2001 Lays
6,220,375 B1 4/2001 Butcher
6,257,673 B1 7/2001 Markham
6,258,139 B1 7/2001 Jensen
6,260,639 B1 7/2001 Yong
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,408,959 B2 6/2002 Bertagnolli et al.
6,419,278 B1 7/2002 Cunningham
6,460,637 B1 10/2002 Siracki et al.
6,478,383 B1 11/2002 Ojanen
6,484,826 B1 11/2002 Anderson
6,499,547 B2 12/2002 Scott
6,508,318 B1 1/2003 Linden et al.
6,517,902 B2 2/2003 Drake
6,585,326 B2 7/2003 Sollami
6,596,225 B1 7/2003 Pope et al.
6,601,662 B2 8/2003 Matthias et al.
6,672,406 B2 1/2004 Beuershausen
6,685,273 B1 2/2004 Sollami
6,692,083 B2 2/2004 Latham
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,557 B2 9/2004 Montgomery, Jr.
6,824,225 B2 11/2004 Stiffler
6,846,045 B2 1/2005 Sollami
6,851,758 B2 2/2005 Beach
6,854,810 B2 2/2005 Montgomery, Jr.
6,861,137 B2 3/2005 Griffin
6,889,890 B2 5/2005 Yamazaki
6,933,049 B2 8/2005 Wan et al.
6,966,611 B1 11/2005 Sollami
6,994,404 B1 2/2006 Sollami
7,048,081 B2 5/2006 Smith
7,204,560 B2 4/2007 Mercier
7,350,601 B2 4/2008 Belnap
7,592,077 B2 9/2009 Gates, Jr. et al.
7,665,552 B2 * 2/2010 Hall et al. ..... 175/426
7,703,559 B2 4/2010 Shen et al.
7,798,258 B2 * 9/2010 Singh et al. ..... 175/430
2001/0004946 A1 6/2001 Jensen
2002/0175555 A1 11/2002 Mercier
2003/0044800 A1 3/2003 Connelly
2003/0141350 A1 7/2003 Noro
2003/0209366 A1 11/2003 McAlvain
2003/0217869 A1 11/2003 Snyder
2003/0234280 A1 12/2003 Cadden
2004/0026983 A1 2/2004 McAlvain
2004/0065484 A1 4/2004 McAlvain
2005/0044800 A1 3/2005 Hall
2005/0159840 A1 7/2005 Lin
2005/0173966 A1 8/2005 Mouthaan
2005/0263327 A1 * 12/2005 Meiners et al. ..... 175/430
2006/0086537 A1 4/2006 Dennis
2006/0237236 A1 10/2006 Sreshta
2008/0006448 A1 * 1/2008 Zhang et al. ..... 175/430
2008/0142276 A1 * 6/2008 Griffo et al. ..... 175/432
2008/0156544 A1 * 7/2008 Singh et al. ..... 175/341

FOREIGN PATENT DOCUMENTS

DE 3818213 11/1989
DE 4039217 6/1992
DE 19821147 11/1999
DE 10163717 5/2003
EP 0295151 6/1988
EP 0412287 7/1990
GB 2004315 3/1979
GB 2037223 11/1979
JP 5280273 10/1993
JP 3123193 1/2001

* cited by examiner

CHAMFERED POINTED ENHANCED DIAMOND INSERT

BACKGROUND OF THE INVENTION

The invention relates to high-impact resistant tools, or impact tools, such as those installed in machinery used in a high impact-type service or operation, such as earth-boring drill bits. These tools are commonly subjected to high impact loads, vibrations, high temperatures and pressures, and other adverse conditions. Frequent replacement of the high-impact resistant tools is undesirable, though often necessary due to spalling, delamination, and abrasive wear. Accordingly, efforts have been made to increase the life of such tools.

Such efforts are disclosed in U.S. Pat. No. 4,109,737 to Bovenkerk, which is herein incorporated by reference for all that it contains. Bovenkerk discloses a rotary drill bit for rock drilling comprising a plurality of cutting elements mounted by interference-fit in recesses in the crown of the drill bit. Each cutting element comprises an elongated pin with a thin layer of polycrystalline diamond bonded to the free end of the pin.

U.S. Pat. No. 5,544,713 to Dennis, which is herein incorporated by reference for all that is contains, discloses a cutting element which has a metal carbide stud having a conic tip formed with a reduced diameter hemispherical outer tip end portion of the metal carbide stud. A layer of polycrystalline material, resistant to corrosive and abrasive materials, is disposed over the outer end portion of the metal carbide stud to form a cap. An alternate conic form has a flat tip face. A chisel insert has a transecting edge and opposing flat faces. It is also covered with a PDC layer.

U.S. Pat. No. 6,484,826 to Anderson which is herein incorporated by reference for all that it contains, discloses enhanced inserts are formed having a cylindrical grip and a protrusion extending from the grip. An ultra hard material layer is bonded on top of the protrusion. The inserts are mounted on a rock bit and contact the earth formations off center. The ultra hard material layer is thickest at a critical zone which encompasses a major portion of the region of contact between the insert and the earth formation. Transition layers may also be formed between the ultra hard material layer and the protrusion so as to reduce the residual stresses formed on the interface between the ultra hard material and the protrusion.

U.S. Pat. No. 5,848,657 by Flood et al., which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material is disposed over the distal end portion such that an annulus of metal carbide adjacent and above the drill bit is not covered by the abrasive material layer.

BRIEF SUMMARY OF THE INVENTION

In one aspect of the present invention, an impact tool comprises an impact body made from a superhard material, and which is bonded to a carbide substrate at a non-planer interface. The impact body comprises a pointed geometry with a substantially frustoconical portion between an apex and a base end, the substantially frustoconical portion including a tapering side wall with at least two different, contiguous slopes or frustoconical surfaces that form an interior included angle which is greater than 135 degrees. The thickness of the impact body, as measured from the apex to the non-planer interface, is greater than the thickness of the carbide substrate.

The carbide substrate may be generally cylindrical- or disc-shaped, and includes the non-planer interface formed into an end face which, may comprise a tapered surface starting from an edge with the outer side surface of the substrate and ending at an elevated flatted region formed in the center of the end face. The diameter of the flatted central region may comprise a diameter between one fourth and three-fourths the diameter of the outer side surface of the cylindrical- or disc-shaped substrate.

The volume of the impact body may be 75 to 150 percent of the volume of the carbide substrate. The thickness from the apex of the impact body to the non-planer interface may be greater than twice the thickness of the carbide substrate. The apex of the impact body may be rounded about an axis perpendicular to the central axis to include a radius of curvature between 0.050 inches to 0.125 inches.

A substantially circumferential edge may be formed into the outer surface of the impact body at an interface between the substantially frustoconical portion and the rounded apex's radius of curvature. The circumferential edge may be rounded or chamfered to reduce the sharpness of the edge. The rounded apex may comprise a radius of curvature greater than a diameter of the circumferential edge. The circumferential edge may comprise a diameter less than one tenth the diameter of the cylindrical rim or edge of the outer side surface of the substrate.

The impact tool may be asymmetric with respect to a central axis, and may be used in a drag bit or other types of earth-boring machines.

In another aspect of the present invention, a method for forming a high-impact resistant tool comprises providing a pre-shaped can containing diamond powder adjacent a carbide substrate, sintering the pre-shaped can in a high-pressure, high-temperature press to form an impact body made from sintered diamond and having with a substantially conical geometry, and with the sintered diamond comprising a greater volume than the carbide substrate, removing the can from the impact body and carbide substrate, and forming a chamfer at the circumferential edge located between the rounded apex and the substantially frustoconical portion on the impact tool.

The diamond powder and carbide substrate may be loaded into the can in an inert environment. The inert environment may comprise a vacuum, or an inert gas such as argon. The diamond powder and substrate may be heated before the can is sealed, and the method may comprise an additional step of sealing the can by melting a disk inside the can. The chamfer proximate the apex may be formed by grinding.

DETAILED DESCRIPTION OF EXEMPLARY EMBODIMENTS

Figure 1A:
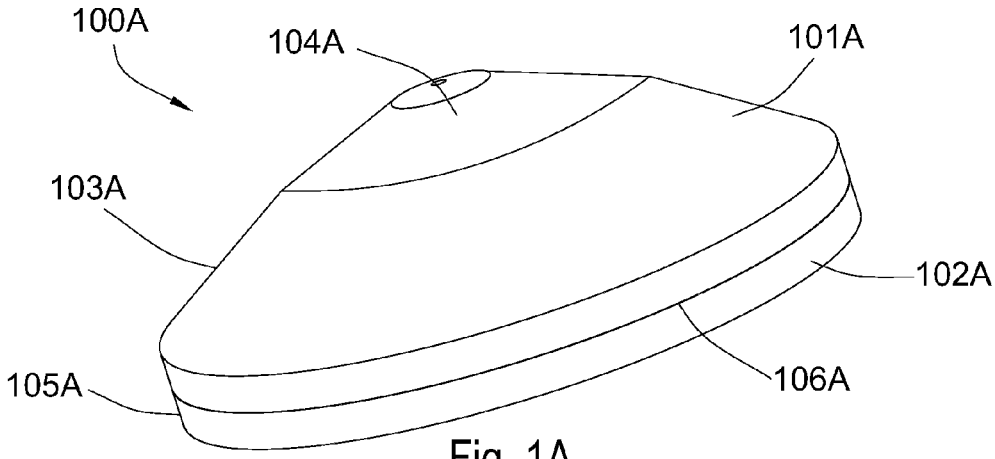
FIG. 1A is a perspective view of an impact tool, in accordance with one embodiment of the present invention.

Referring now to the figures, FIG. 1A discloses an impact tool 100A adapted for use in a high impact-type service or operation, according to one representative embodiment of the present invention. The impact tool 100A comprises a pointed impact tip or body 101A made from a superhard material that is bonded to a carbide substrate 102A at a non-planer interface 106A. The pointed impact body 101A comprises a substantially frustoconical portion 103A between an apex 104A and a base end that is bonded to the carbide substrate 102A. The superhard material forming the impact body 101A may comprise polycrystalline diamond, cubic boron nitride, or another suitably hard crystalline material.

The carbide substrate 102A may comprise a generally cylindrical- or disc-shaped body having an outer side surface 105A, and may be adapted for attachment to an implement for use in a high impact-type service, such as a drag bit, by brazing or with an interference fit. In some embodiments, the tool 100A may also be attached to other implements used in high impact-type service, such as picks, milling picks, trenching picks, mining picks, bits, roller cone bits, and percussion bits.

Figure 1B:
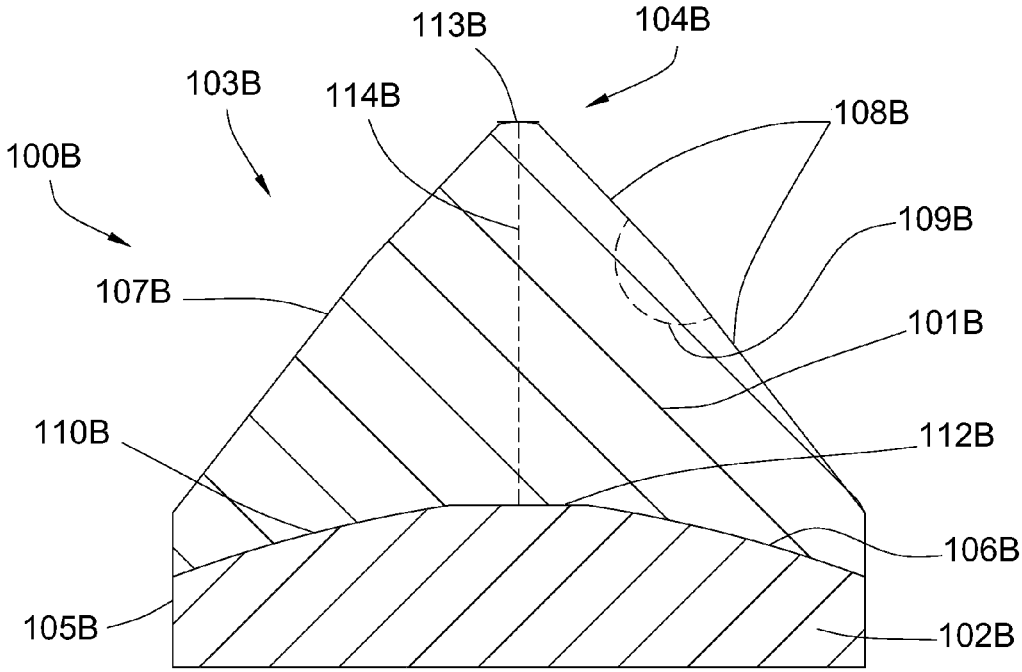
FIG. 1B is a cross-sectional view of another embodiment of the impact tool.

FIG. 1B is a cross-sectional side view of the impact tool 100B, in accordance with another embodiment. The impact tool includes a pointed impact tip or body 101B made from a superhard material and having a substantially frustoconical portion 103B between an apex 104B and a base end bonded to a carbide substrate 102B. The base end of the impact body 101B may be bonded to the carbide substrate 102B at a non-planer interface 106B.

The substantially frustoconical portion 103B of the impact body comprises a tapering side wall 107B with at least two different, contiguous slopes 108B. The different, contiguous slopes 108B or frustoconical surfaces can form an interior included angle 109B of greater than 135 degrees, and may be formed during sintering in an HPHT press, by grinding, or combinations thereof. In a preferred embodiment the interior included angle 109B can be about 174 degrees.

The substantially frustoconical portion 103B of the impact body 101B is positioned between an apex 104B and a base end of the impact body 101B. The apex 104B may be rounded about an axis perpendicular to the central axis to include a radius of curvature 113B of between 0.050 and 0.125 inches, most preferably 0.080B inches. The thickness 114B of the impact body 101B between the apex and the non-planer interface 106B at the base end is greater than the thickness of the carbide substrate 102B, and in some aspects may be twice the thickness of the carbide substrate.

The carbide substrate 102B would be understood by one of ordinary skill in the art to be made primarily of a cemented metal carbide, and to include features that allow the tool to be attached to implements such as bits, picks, or other objects. For instance, the outer side surface 105B of the substrate 102B may be formed with a diameter that is sized and shaped for press fitting into a recess formed into one of the implements described above, or may include an interface that is capable of being bonded to the bit, pick, or other object.

The non-planer interface 106B may comprise a substantially tapered surface 110B disposed intermediate an edge of the outer side surface 105B of the substrate body and an elevated, flatted central region 112B formed into the end face of the substrate. The elevated, flatted central region 112B may comprise a diameter between one-fourth and three-fourths the diameter of the outer side surface 105B of the generally cylindrical- or disc-shaped substrate 102B. The tapered surface 110B may comprise a constant slope, a curve with constant radius, a curve with varying radius, or combinations thereof. It is believed that the non-planer interface 106B improves the mechanical attachment between the impact body 101B and the carbide substrate 102B by increasing the bond surface area. The non-planer surface formed into the end face of the substrate may also comprise grooves, ribs, nodules, or other geometric features intended to improve the mechanical attachment.

The volume of the impact body 101B may be greater than the volume of the carbide substrate 102B, preferably between 75 and 150 percent of the volume of the carbide substrate. It is believed that the large volume of superhard material with respect to the carbide substrate, combined with the substantially frustoconical geometry of the impact body, improves impact resistance.

Figure 2:
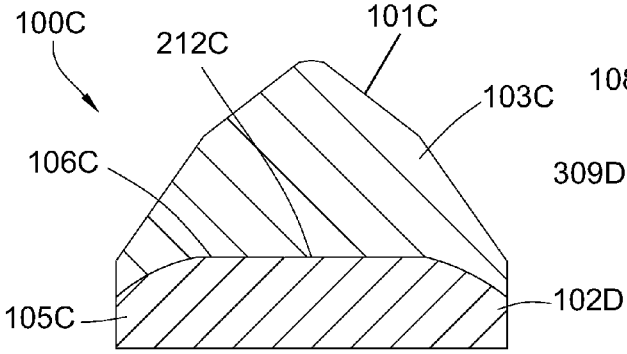
FIG. 2 is a cross-sectional view of another embodiment of the impact tool.

Referring now to FIG. 2, another embodiment of the impact tool 100C includes an impact body 101C having a substantially frustoconical portion 103C, and with a base end that is bonded to a carbide substrate 102C at a non-planer interface 106C. Non-planer interface 106C comprises an elevated, flatted central region 212C that is substantially three-fourths of the diameter of the outer side surface 105C of the cylindrical- or disc-shaped carbide substrate 102C.

Figure 3:
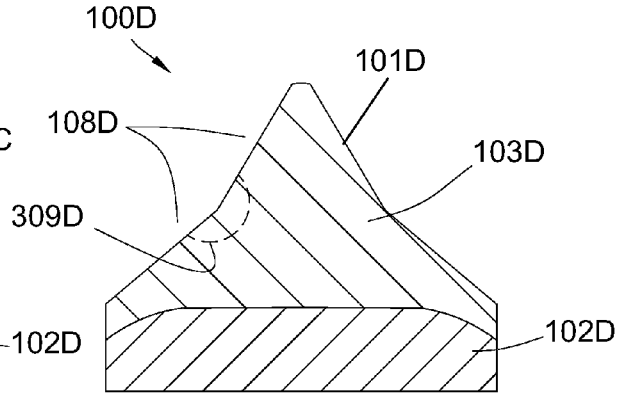
FIG. 3 is a cross-sectional view of another embodiment of the impact tool.

FIG. 3 discloses another embodiment of the impact tool 100D. In this embodiment, the substantially frustoconical portion 103D of the impact body 101D which bonded to a carbide substrate 102D comprises two different, contiguous slopes 108D or frustoconical surfaces that form an interior included angle 309D that is greater than 180 degrees, thus, forming an impact body 101D having a substantially frustoconical portion 103D with a concave side wall.

Figure 4:
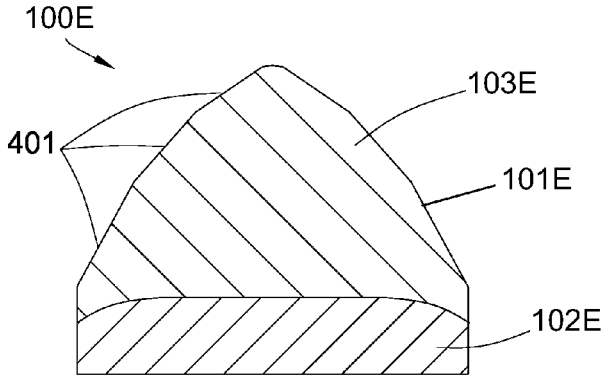
FIG. 4 is a cross-sectional view of another embodiment of the impact tool.

FIG. 4 discloses another embodiment of the impact tool 100E. In this embodiment, the substantially frustoconical portion 103E of the impact body 101E which is bonded to the carbide substrate 102E comprises three different, contiguous slopes 401.

Figure 5:
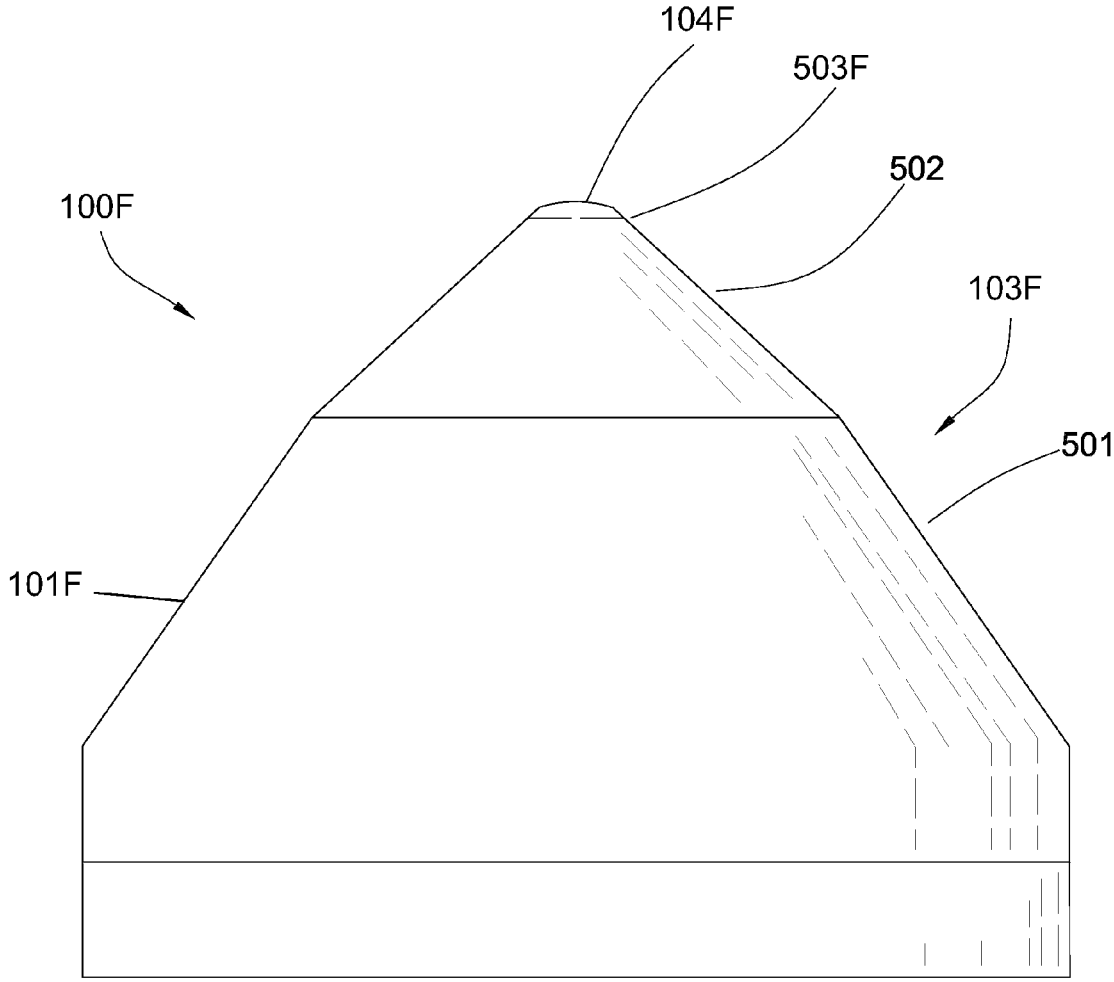
FIG. 5 is side view of another embodiment of the impact tool.

FIG. 5 discloses another embodiment of the impact tool 100F which includes an impact body 101F having a substantially frustoconical portion 103F with a lower segment having a lower sloped surface 501 and an upper segment having an upper sloped surface 502. In this embodiment, the lower sloped surface 501, the upper sloped surface 502, or both may be formed by grinding or another machining operation. Furthermore, the grinding of the upper sloped surface 502 may create a substantially circumferential edge 503F proximate the rounded apex 104F of the impact body 101F. The circumferential edge 503F may be undesirably sharp after the forming operation and may be subject to accelerated abrasive wear or stress concentrations. Therefore, it may be desirable to round or chamfer the circumferential edge 503F.

Figure 6:
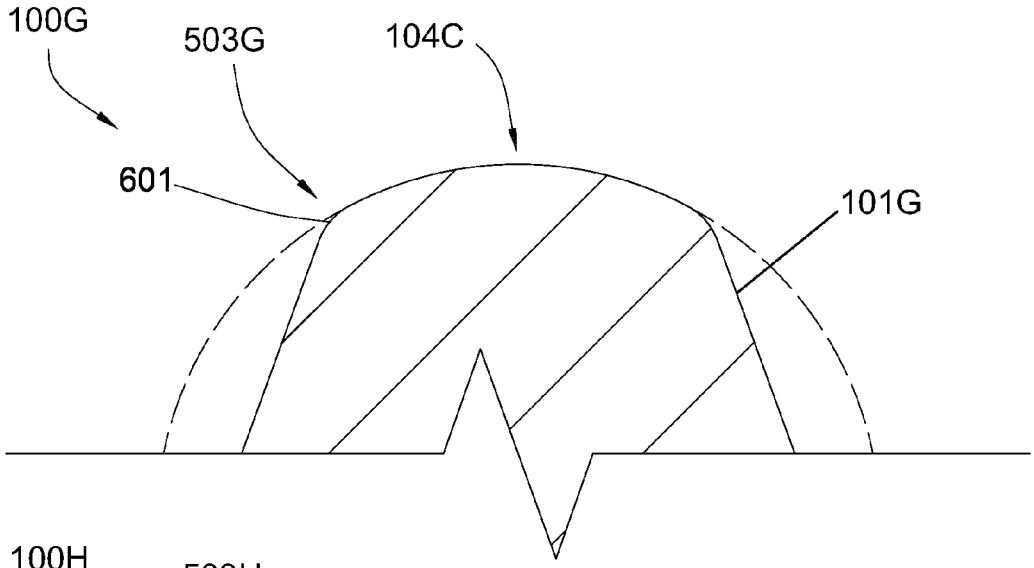
FIG. 6 is an enlarged, cross-sectional view of another embodiment of the impact tool.

FIG. 6 is an enlarged view of the forward end of the impact body 101G of another embodiment of the impact tool 100G, and which includes a substantially circumferential edge 503G proximate a rounded apex 104G having a first radius of curvature. In this embodiment, the circumferential edge 503G comprises a rounded surface with second radius of curvature 601. The second radius of curvature 601 may be less than 0.005 inches, and may be formed with a grinding wheel, a sanding belt or disk, or by hand. Because the impact body 101G of the impact tool 100G comprises a superhard material such as polycrystalline diamond, the abrasive media used to form the rounded surface with the radius of curvature 601 may comprise a hardness that is equal to or greater than the hardness of the superhard material forming the impact body 101G.

Figure 7:
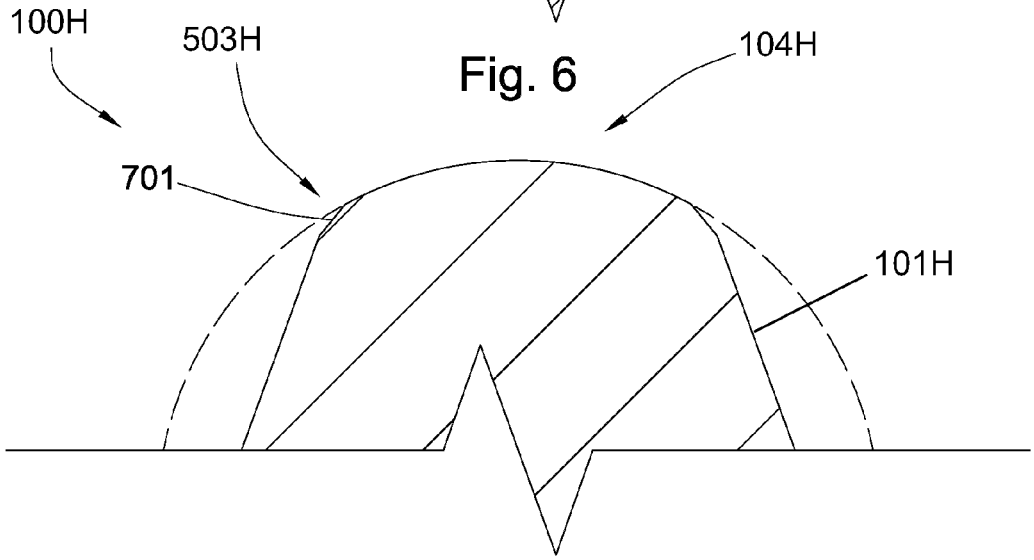
FIG. 7 is an enlarged, cross-sectional view of another embodiment of the impact tool.

FIG. 7 is an enlarged view of the forward end of the impact body 101H of another embodiment of the impact tool 100H. In this embodiment, the circumferential edge 503H proximate the rounded apex 104H comprises a chamfered surface 701. The chamfered surface 701 may be formed in a similar way to those previously discussed above with respect to the rounded surface having a second radius of curvature.

Figure 8:
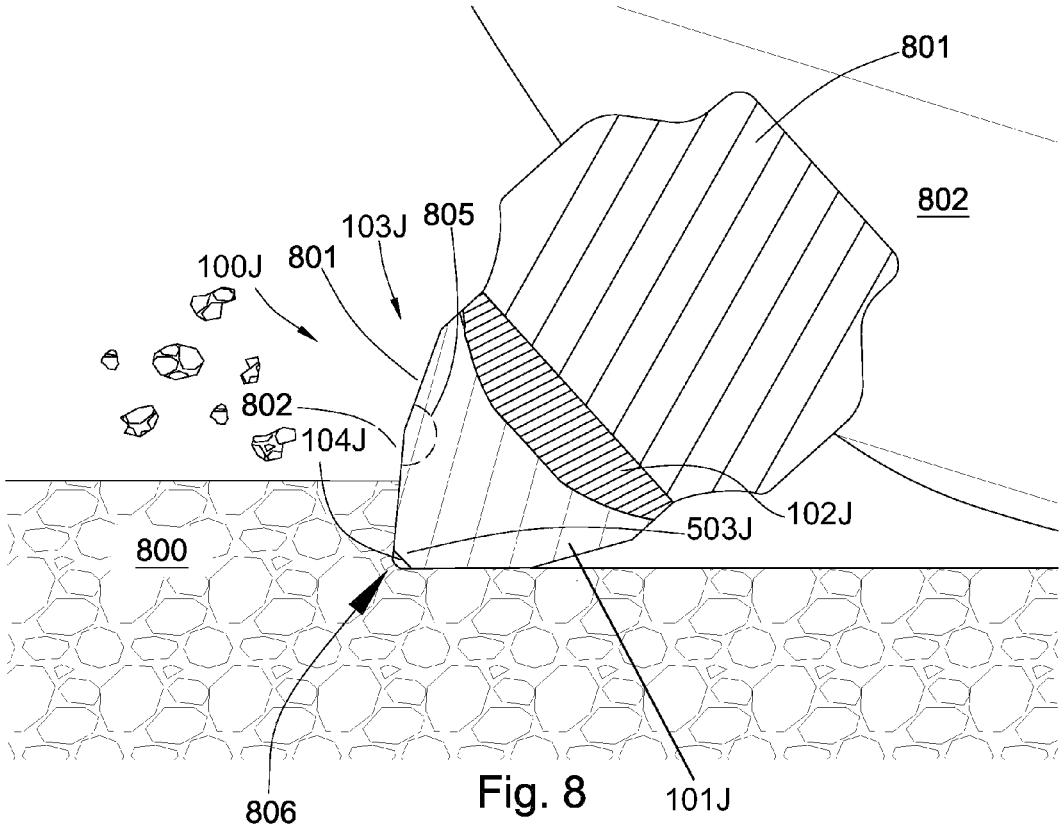
FIG. 8 is a cross-sectional view of another embodiment of the impact tool as may be used when impacting against a formation.

FIG. 8 discloses another embodiment of the impact tool 100J while impinging a formation 800. The impact tool 100J comprises an impact body 101J with a pointed geometry made from a superhard material, and with a substantially frustoconical portion 103J between a base end and a rounded apex 104J. The impact tool 100J further comprises a carbide substrate 102J which may in turn be brazed or otherwise affixed to a carbide bolster 801. The carbide bolster may be attached to an earth boring tool such as the body of a drag bit 802. The body of the drag bit 802 may comprise alloyed steel, a steel carbide matrix, or combinations thereof. The carbide bolster 801 may comprise a higher stiffness than the bit body 802, and thus deflect less under similar impacts to provide a more stable base for the impact tool 100J. This may increase the life of the impact tool by preventing flexure-induced fractures in the superhard material forming the impact body 101J. As will be appreciated by one of skill in the art, the carbide bolster 801 may be attached to the bit body 802 by brazing, a press fit, or another method.

It is believed that cylindrical impact tools currently in use provide an aggressive cutting edge when new, but quickly dull during use. The aggressive cutting edge may also be susceptible to spalling and delamination; accordingly, many impact tools in commercial use feature blunted or hemispherical profiles. To maintain cutting speed with either worn or intentionally blunt impact tools, it may be necessary to increase the weight on bit (WOB) which in turn places more stress on the tools and accelerates wear and may have other undesirable effects.

It is believed that impact tools featuring a substantially conical portion of superhard material may provide substantially longer life than cylindrical impact tools. It is thought that with correct orientation, the impact tool with a substantially conical portion experiences less shear stress in use than a cylindrical impact tool. In addition, the apex of the substantially conical portion may penetrate the formation more effectively and may create quasi-hydrostatic forces proximate the apex. This reduces the effective (or von Mises) stress level in the tool and thus may reduce occurrence of failure. However, the substantially conical impact tools do not cut as aggressively as new cylindrical impact tools, and thus initially require higher WOB to achieve the same drilling rate.

It is therefore desirable to combine the long life and resistance to spalling and delamination of substantially conical impact tools with the aggressive initial cutting action of cylindrical impact tools.

Referring again to FIG. 8, the substantially frustoconical portion 103J of the impact body 101J comprises two different, contiguous slopes 801 and 802. The upper slope 802 may form a substantially circumferential edge 503J proximate the rounded apex 104J of the impact body 101J. A diameter of the circumferential edge 503J may be less than the radius of curvature of the apex 104J. The interior included angle 805 between slopes 801 and 802 is greater than 135 degrees and may be about 174 degrees in a preferred embodiment.

In this way, an aggressive cutting point 806 is formed at the rounded apex 104J of the impact body 101J, while retaining a broad geometry with a high volume of superhard material proximate the carbide substrate 102J to provide buttressing and impact absorption. It is thought that this geometry will reduce the initial WOB required for the drilling operation and that the substantially frustoconical geometry of the impact body 101J will be less susceptible to spalling or delamination.

Figure 9:
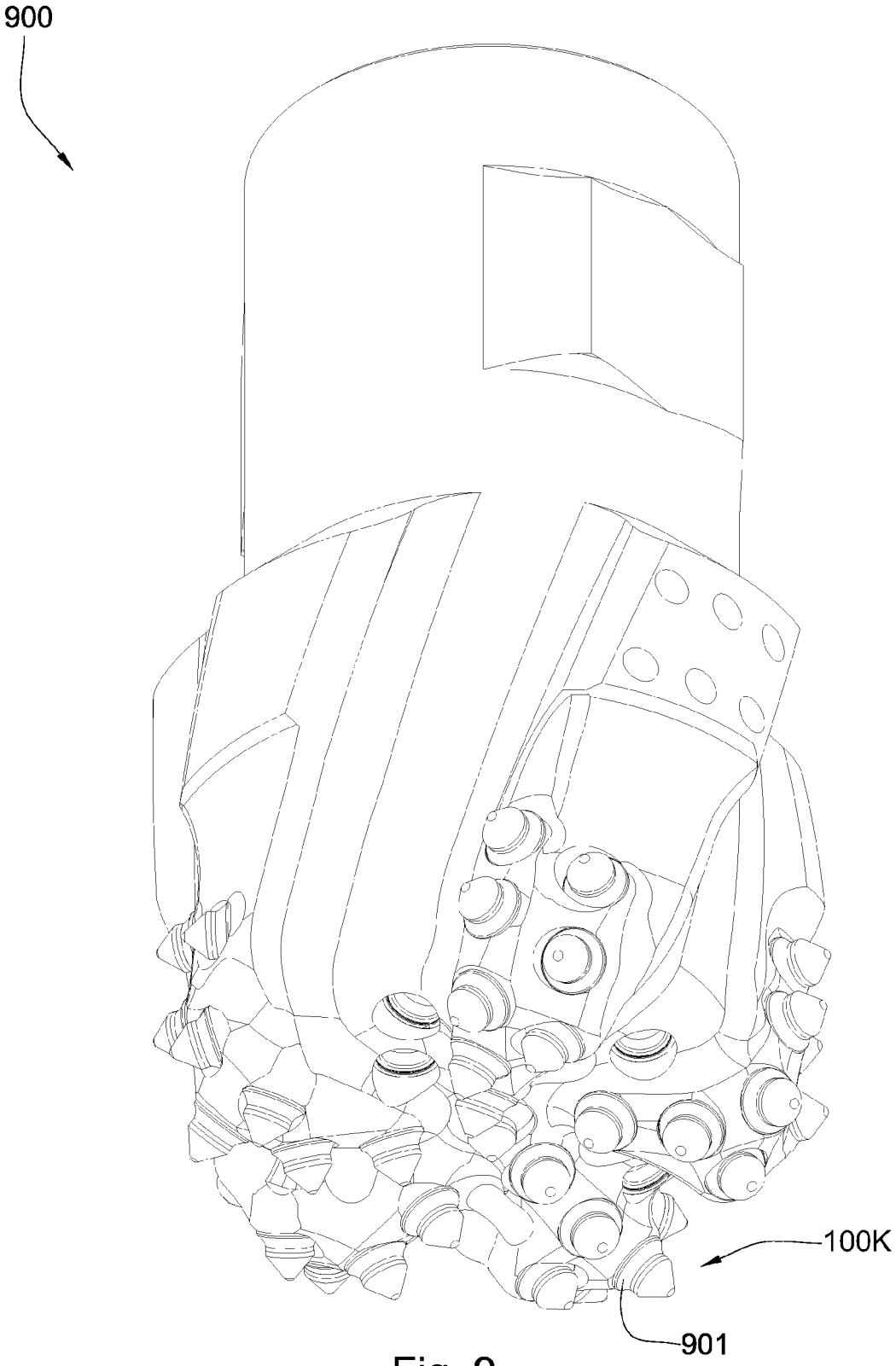
FIG. 9 is a perspective view of an embodiment of a drag bit.

FIG. 9 discloses an embodiment of a drag bit 900 comprising a plurality of impact tools 100K. The impact tools may be brazed to carbide bolsters 901, after which the bolsters may be press fitted or brazed to the drag bit 900.

Figure 10:
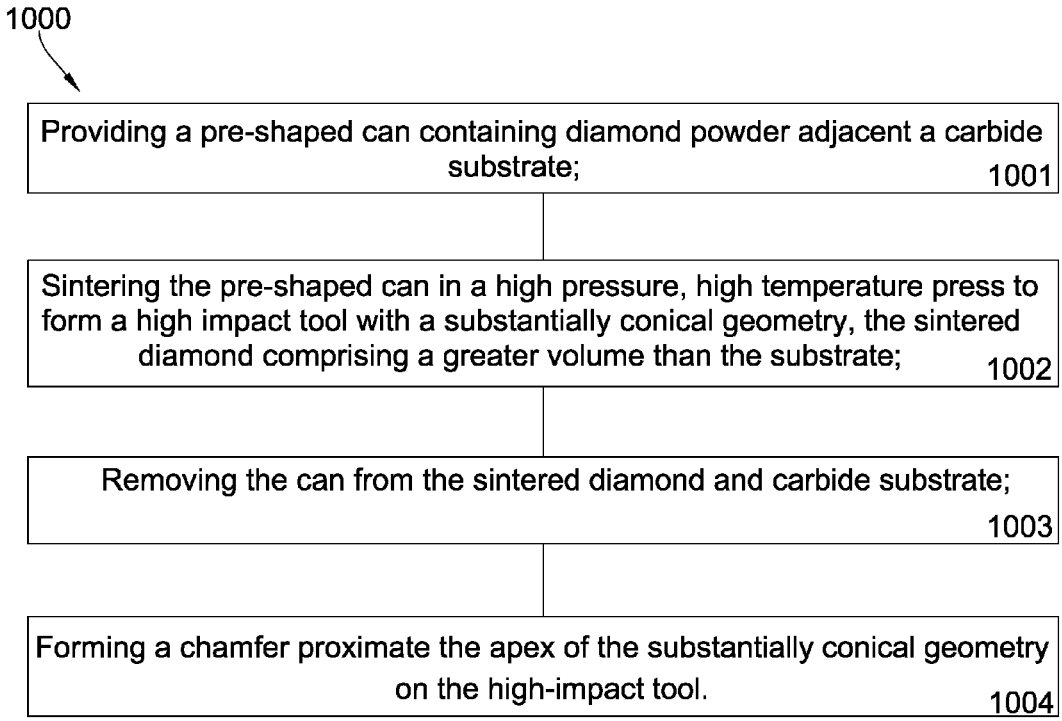
FIG. 10 is a flowchart illustrating a method for forming a high impact tool, in accordance with another embodiment.

FIG. 10 is a method 1000 for forming a high impact tool comprising the steps of providing 1001 a pre-shaped can containing diamond powder adjacent a carbide substrate; sintering 1002 the pre-shaped can in a high pressure, high temperature press to form a high impact tool with substantially conical geometry, the sintered diamond comprising a greater volume than the substrate; removing 1003 the pre-shaped can from the sintered diamond and carbide substrate; and forming 1004 a chamfer proximate the apex of the substantially conical geometry of the high impact tool.

Figure 11:
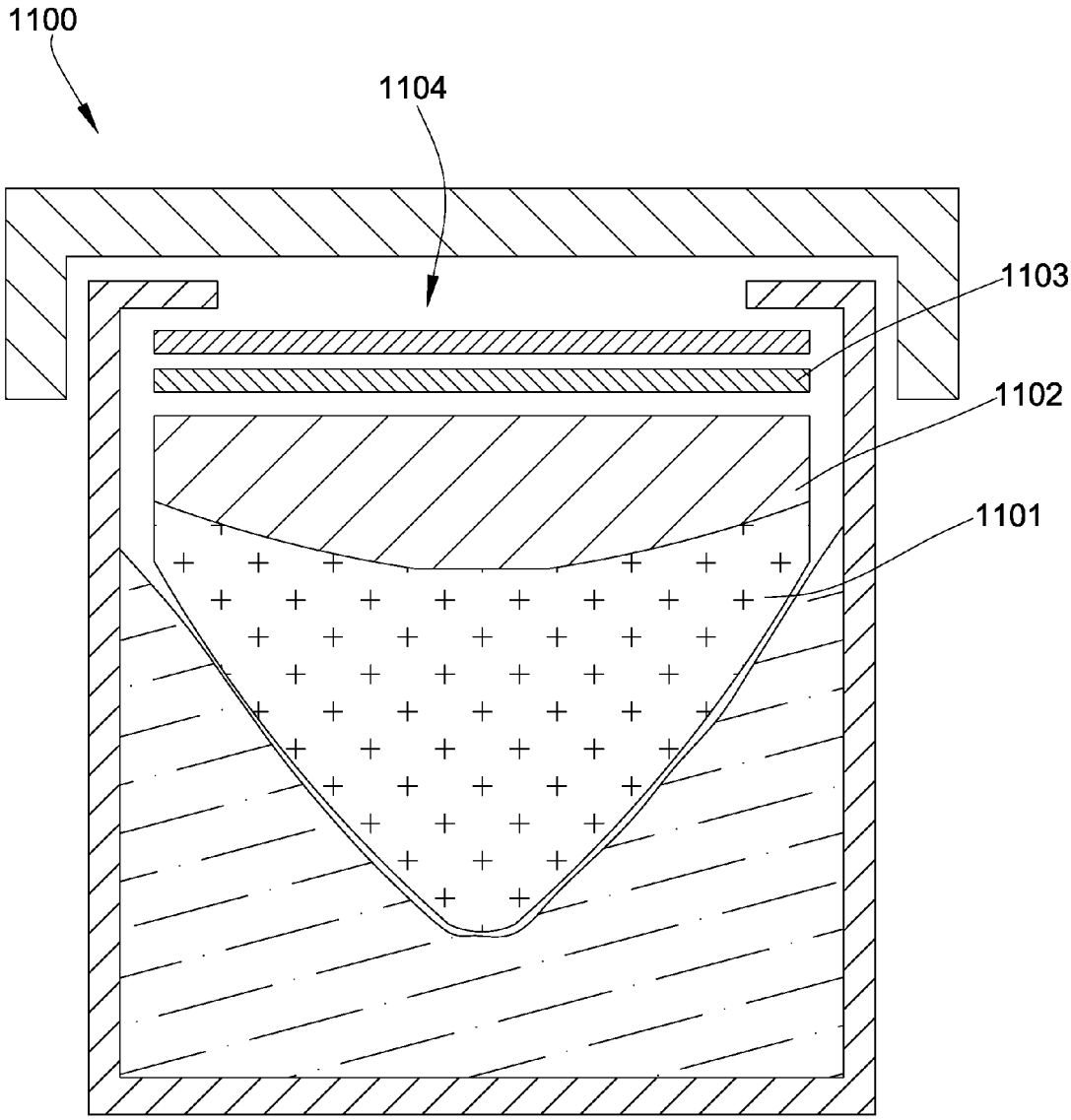
FIG. 11 is a cross-sectional view of a pre-shaped can, diamond powder, and carbide substrate, in accordance with another embodiment for making the impact tool.

FIG. 11 discloses an embodiment of a pre-shaped can 1100 containing diamond powder 1101 adjacent a carbide substrate 1102. The can 1100 may comprise niobium or a niobium alloy. A meltable disk 1103 may be disposed proximate an opening 1104 of the can 1100. The meltable disk 1103 may be made from copper, copper alloys, or another material with sufficiently low melting temperature. The can and contents may be assembled in an inert environment comprising a substantial vacuum or an inert gas such as argon to prevent environmental contamination. After assembly, the can may be pre-heated in an inert environment to remove any impurities present in the diamond powder. This may be done at a temperature between 800 and 1050 degrees Celsius for 15 to 60 minutes. The pre-shaped can may undergo an additional heating cycle to melt the disk 1103 and seal the diamond powder and carbide substrate in the can. The melting temperature may be higher than the cleansing temperature, preferably between 1000 and 1200 degrees Celsius. This temperature may be maintained for 2 to 25 minutes. The pre-shaped can may now be ready for processing in a high pressure, high temperature press.

Figure 12:
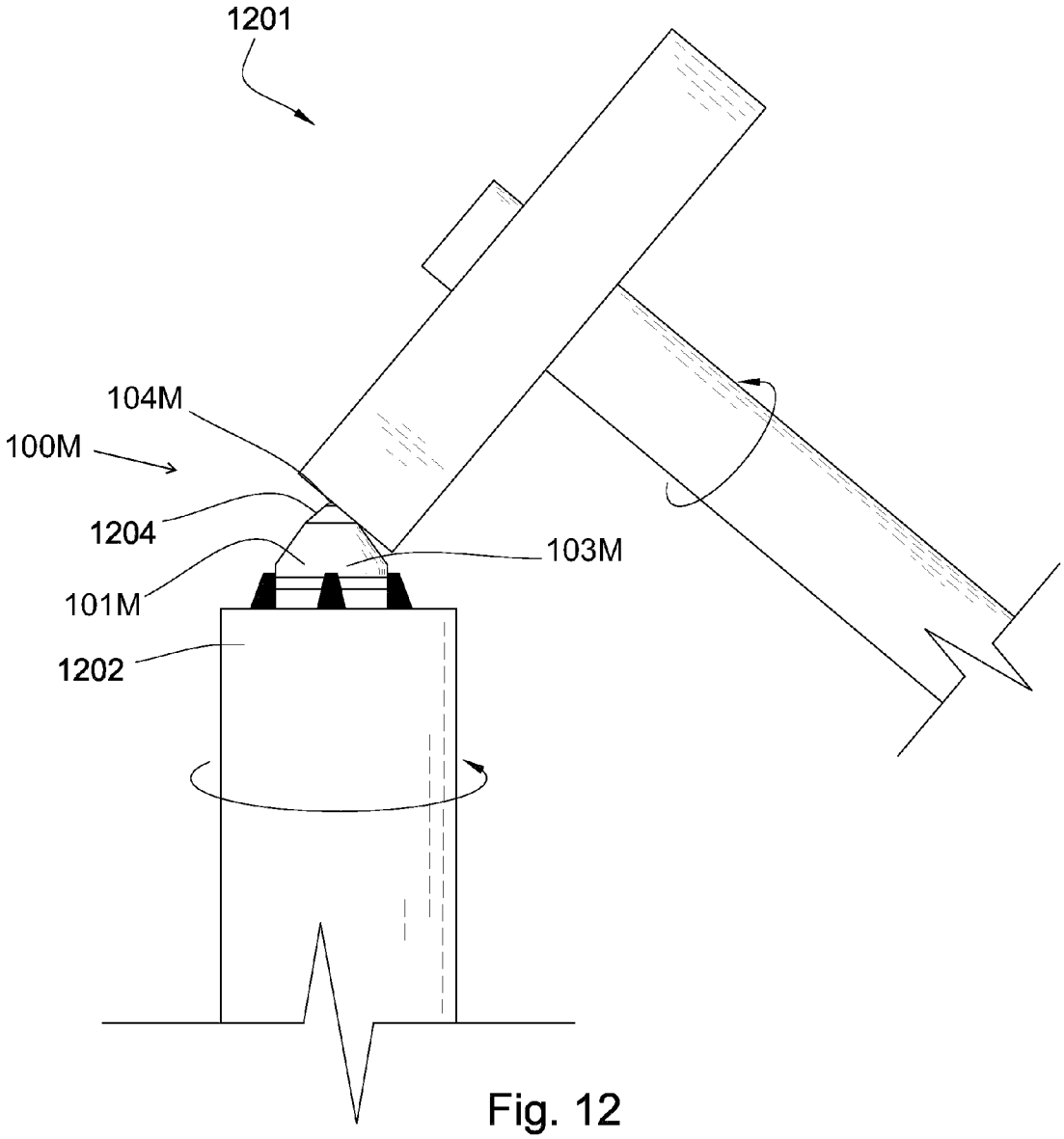
FIG. 12 is a perspective view of an impact tool mounted into a grinding station, in accordance with another embodiment for making the impact tool.

FIG. 12 discloses an embodiment of an impact tool 100M mounted into a fixture 1202 of a grinding tool 1201 such as a rotating chuck or collet, after which the substantially frustoconical portion 103M of the impact body 101 M is brought into contact with a rotating grinding wheel 1203 to form a chamfer surface 1204 proximate the apex 104M of the impact body 101M. Grinding wheel 1203 may comprise diamond or other superhard media, and may be air or fluid cooled.

Whereas the present invention has been described in particular relation to the drawings attached hereto, it should be understood that other and further modifications apart from those shown or suggested herein, may be made within the scope and spirit of the present invention.

What is claimed is:

1. An impact tool having a longitudinal center axis, the impact tool comprising:

a substrate having a first end and a second end spaced from the first end at a first distance, the substrate being made from a cemented metal carbide material; and an impact body having a pointed geometry, the impact body being made from a superhard material, the impact body including:

a base end bonded to the first end of the substrate at a non-planer interface;

an apex spaced from the base end at a second distance, the second distance being greater than the first distance; and a substantially frustoconical portion between the base end and the apex, the substantially frustoconical portion including a tapering side wall with at least two different, contiguous slopes forming an interior angle, the interior angle being greater than about 135 degrees.

2. The impact tool of claim 1, wherein the non-planar interface includes a tapered surface starting from an outer side surface of the substrate and ending at an elevated flatted central region formed into an end face of the substrate.

3. The impact tool of claim 2, wherein the central flatted region comprises a diameter of one fourth to three fourths the diameter of the outer side surface.

4. The impact tool of claim 1, wherein a volume of the impact body is 75 to 150 percent of a volume of the substrate.

5. The impact tool of claim 1, wherein the first distance is at least twice the second distance.

6. The impact tool of claim 1, wherein the apex includes a radius of curvature about an axis perpendicular to the longitudinal center axis, the radius of curvature being between 0.050 inch and 0.125 inch.

7. The impact tool of claim 6, further comprising a circumferential edge between the substantially frustoconical portion and the radius of curvature of the apex.

8. The impact tool of claim 7, wherein the circumferential edge is radiused.

9. The impact tool of claim 7, wherein the circumferential edge is chamfered.

10. The impact tool of claim 7, wherein the radius of curvature of the apex is greater than a diameter of the circumferential edge.

11. The impact tool of claim 7, wherein a diameter of the circumferential edge is less than one-tenth of a diameter of an outer side surface of the substrate.

12. The impact tool of claim 1, wherein the apex is offset from the longitudinal center axis of the tool.

13. The impact tool of claim 1, wherein the tool is used in a drag bit.

14. The impact tool of claim 1, wherein the substantially frustoconical portion includes a lower frustoconical section having a tapered lower side surface and an upper frustoconical section having a tapered upper side surface which intersects with the lower side surface, and wherein the intersection between the lower side surface and the upper side surface defines the interior angle.

15. An impact tool having a longitudinal center axis, said impact tool comprising:

a substrate, said substrate having a first end, a second end spaced from said first end, and a substrate thickness between said first end and said second end, said substrate being made from a cemented metal carbide material; and an impact body having a pointed profile, said impact body being made from a superhard material, said impact body including:

a base end bonded to said first end of said substrate;

an apex spaced from the base end;

a substantially frustoconical portion, said substantially frustoconical portion including:

a lower frustoconical section having a tapered lower side surface; and an upper frustoconical section having a tapered upper side surface contiguous with said lower side surface, said lower side surface and said upper side surface together forming an interior angle greater than about 135 degrees; and an impact body thickness between said base end and said apex, said impact body thickness being greater than said substrate thickness.

16. The impact tool of claim 15, wherein said impact body thickness is at least twice said substrate thickness.

17. The impact tool of claim 15, wherein a volume of said impact body is greater than of a volume of said substrate.

18. The impact tool of claim 15, wherein the apex includes a radius of curvature about an axis perpendicular to the longitudinal center axis.

19. The impact tool of claim 18, further comprising a circumferential edge between said substantially frustoconical portion and said radius of curvature of said apex.

20. The impact tool of claim 19, wherein said radius of curvature of said apex is greater than a diameter of said circumferential edge.

21. An impact tool for use in a drag bit, said impact tool having a longitudinal center axis, said impact tool comprising:

a substrate, said substrate having a first end and a second end spaced from said first end at a first distance, said substrate being made from a cemented metal carbide material; and an impact body having a pointed profile, said impact body being made from a superhard material, said impact body including:

a base end bonded to the first end of the substrate at a non-planer interface;

an apex spaced from the base end at a second distance, the second distance being greater than the first distance, said apex having a radius of curvature about an axis perpendicular to said longitudinal center axis;

a substantially frustoconical portion between the base end and the apex, the substantially frustoconical portion including a tapering side wall; and a circumferential edge between said substantially frustoconical portion and said radius of curvature of said apex, said circumferential edge having a diameter which is less than said radius of curvature of said apex.

* * * * *